US007596824B2

(12) United States Patent
Lee

(10) Patent No.: US 7,596,824 B2
(45) Date of Patent: Oct. 6, 2009

(54) DRUM TYPE WASHING MACHINE AND CONTROLLING METHOD THEREOF

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 166 days.

(21) Appl. No.: 10/568,225

(22) PCT Filed: May 2, 2005

(86) PCT No.: PCT/KR2005/001270

§ 371 (c)(1),
(2), (4) Date: Feb. 14, 2006

(87) PCT Pub. No.: WO2005/106097

PCT Pub. Date: Nov. 10, 2005

(65) Prior Publication Data

US 2008/0163435 A1 Jul. 10, 2008

(30) Foreign Application Priority Data

May 3, 2004 (KR) ..... 10-2004-0030968

(51) Int. Cl.
*D06F 33/02* (2006.01)

(52) U.S. Cl. ..... 8/159

(58) Field of Classification Search ..... 8/158, 8/159; 68/12.06, 23.1
See application file for complete search history.

(56) References Cited

U.S. PATENT DOCUMENTS 5,970,555 A * 10/1999 Baek et al. ..... 8/159
6,029,299 A * 2/2000 Baek et al. ..... 8/159
6,640,372 B2 * 11/2003 Ciancimino et al. ..... 8/159
2003/0213070 A1 * 11/2003 Lee et al. ..... 8/159
2005/0076456 A1 * 4/2005 Lee et al. ..... 8/159

FOREIGN PATENT DOCUMENTS

| | | | |
|---|---|---|---|
| EP | 0 302 319 | A1 | 7/1988 |
| JP | 09-276583 | A | 10/1997 |
| JP | 2000-051579 | A | 2/2000 |
| JP | 2001-029682 | A | 2/2001 |
| JP | 2001-224889 | A | 8/2001 |
| JP | 2001-300186 | A | 10/2001 |
| JP | 2002-136792 | A | 5/2002 |
| WO | WO 03/046271 | A1 | 6/2003 |

OTHER PUBLICATIONS

International Search Report dated Jul. 8, 2005.

* cited by examiner

*Primary Examiner*—Joseph L Perrin
(74) *Attorney, Agent, or Firm*—McKenna Long & Aldridge LLP

(57) ABSTRACT

A drum type washing machine and controlling method thereof is provided. In the drum type washing machine, a tub is provided, a drum is installed in the tub to rotate about a horizontal axis, a driving motor rotates the drum, a key input unit receives a washing instruction from a user, a memory stores a reference value for an eccentricity of the drum, a microcomputer controls washing and rinsing operations in accordance with a procedure set by the user upon an input of a start command through the key input unit and its prevents repetition of a preliminary spin drying operation using a measured eccentricity of the drum, and a driving control unit controls velocity of the driving motor in accordance with a control signal of the microcomputer.

12 Claims, 6 Drawing Sheets

RELATED ART

【Figure 2】
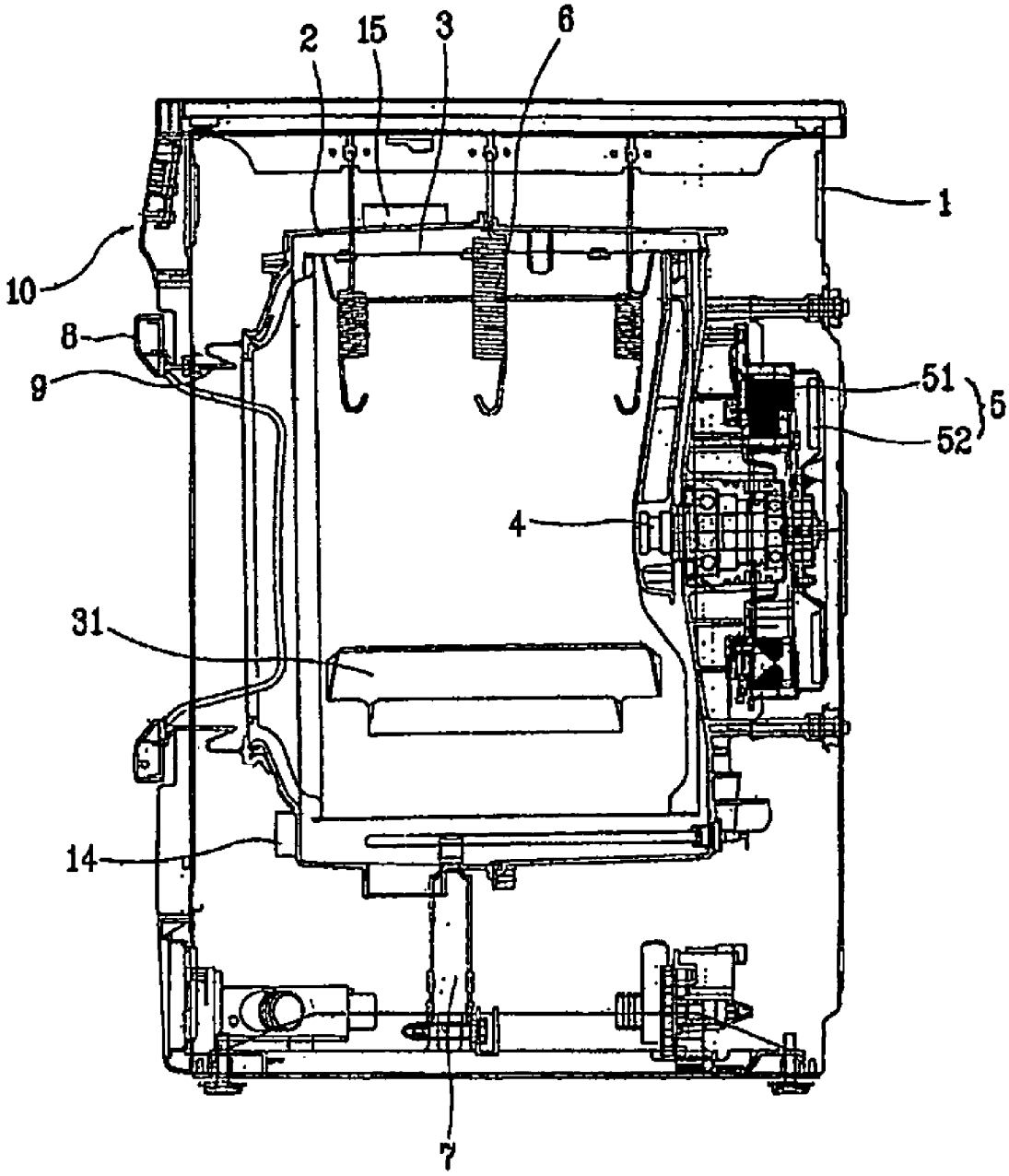

【Figure 3】
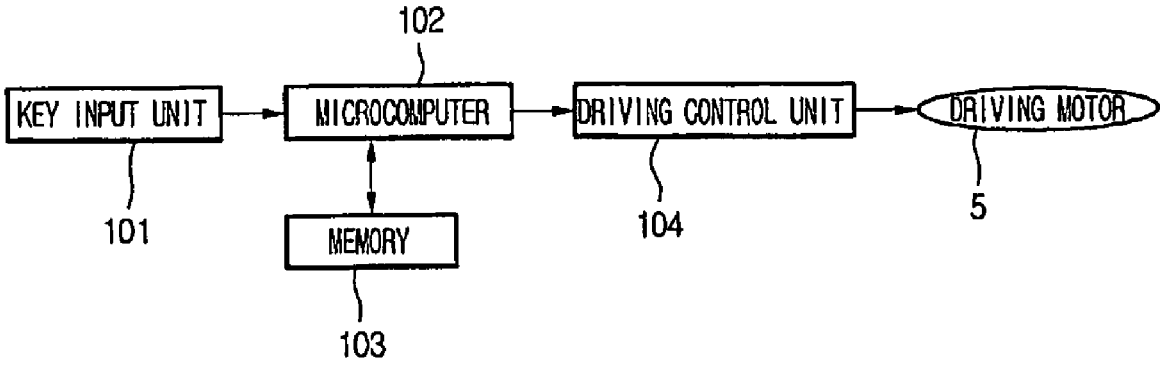

【Figure 4】
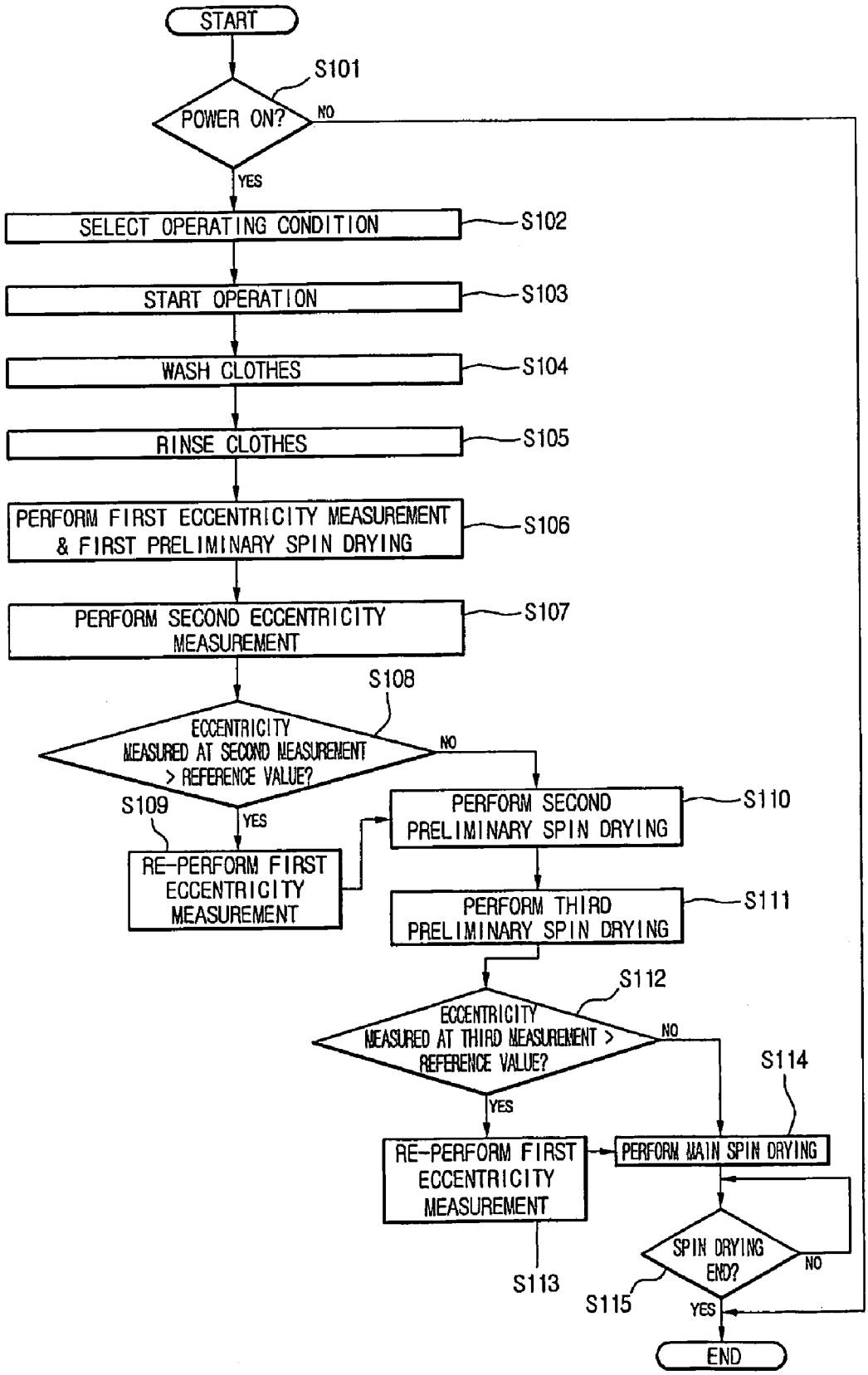

【Figure 5A】
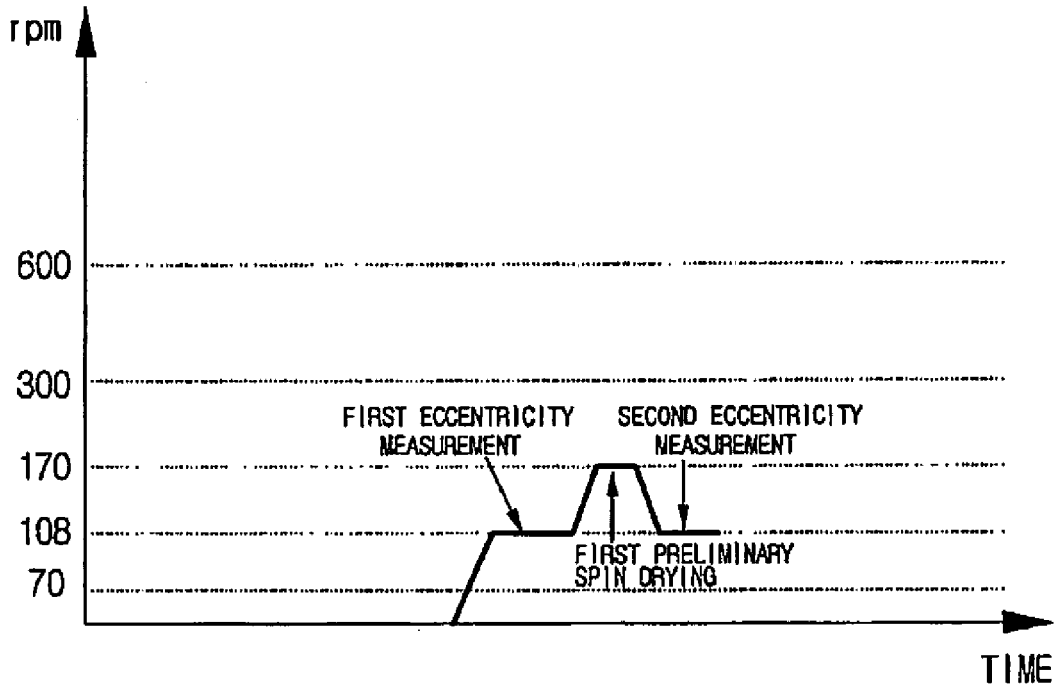
【Figure 5B】
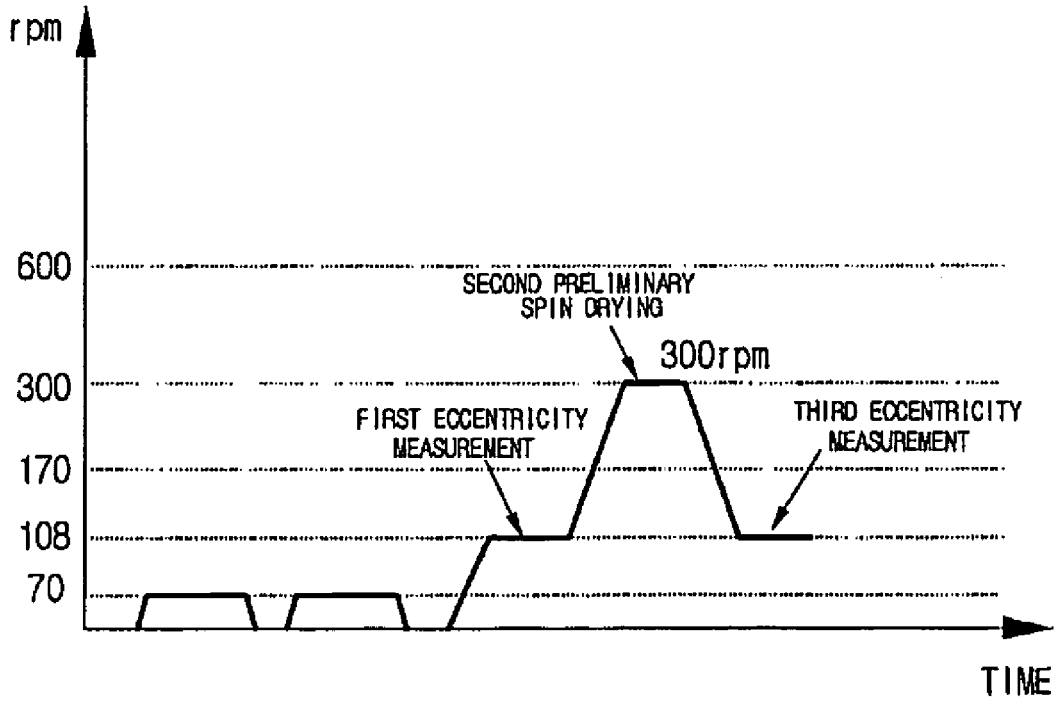

【Figure 5C】
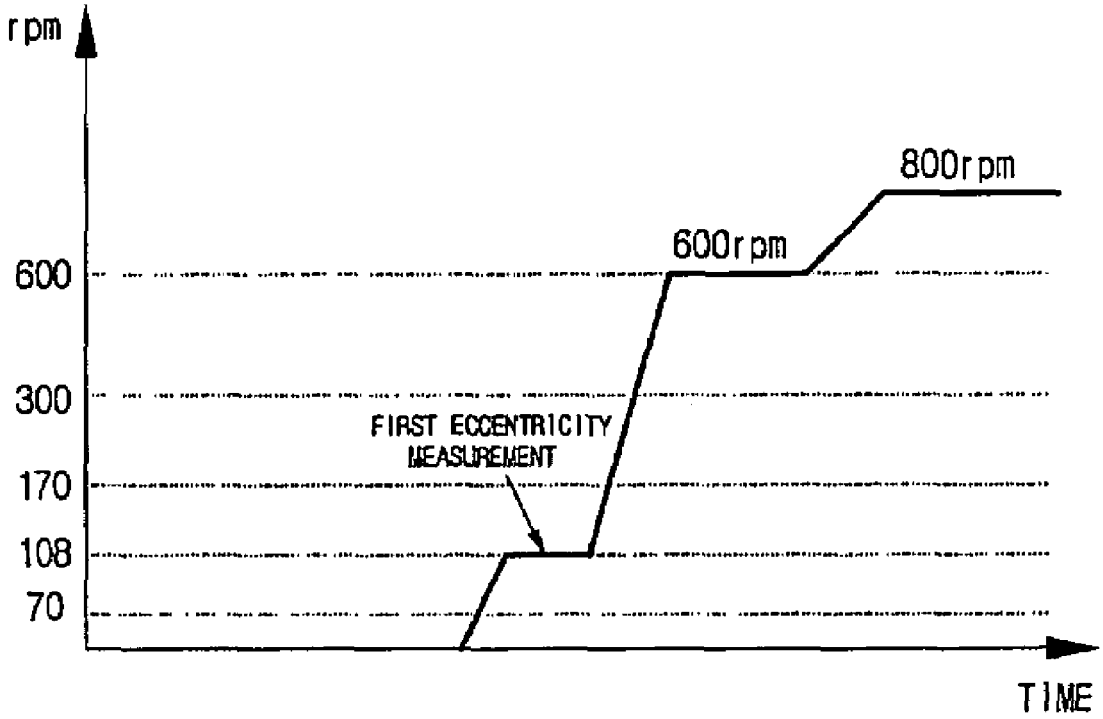

DRUM TYPE WASHING MACHINE AND CONTROLLING METHOD THEREOF

This application claims priority from International application No. PCT/KR2005/001270 filed on May 2, 2005 (WIPO Publication No. WO/2005/106097) and Korean Application No. 10-2004-0030968 filed on May 3, 2004, all of which are incorporated by reference, as fully set forth herein.

TECHNICAL FIELD

The present invention relates to a washing machine, and more particularly, to a drum type washing machine and controlling method thereof, in which a preliminary spin drying can be selectively performed according to the eccentricity of a drum before a main spin drying is started.

BACKGROUND ART

A washing machine is a home appliance for washing clothes automatically. In a typical washing machine, a motor spins a tub to agitate clothes together with water containing detergent to remove dirt from the clothes. The washing machine can be classified into several types such as a pulsator, an agitator, and a drum types.

The drum type washing machine includes a horizontally mounted drum in which clothes, as the drum is rotated, are lifted and dropped to force water and detergent solution to go through the clothes to remove dirt from the clothes. Since the clothes are lifted and dropped in the drum, the drum type washing machine damages the clothes less than the pulsator type washing machine having a vertically mounted tub. Also, the clothes are cleanly washed without tangling as like it is washed with hands. In addition, the clothes are spin dried with less wrinkles.

Meanwhile, the washing process starts upon the pressing of start button after clothes is loaded in the drum and it ends after the clothes are washed, rinsed, and spin-dried.

FIG. 1 is a motor RPM versus time graph of a spin drying of a drum type washing machine according to the related art.

Referring to FIG. 1, a spin-drying process includes a sequence of operations: an unraveling operation of tangled clothes, first to third balancing operations, first and second preliminary spin dryings, an accelerating operation, and a main spin drying.

In the unraveling operation, the drum is rotated at about 50 rpm for a specific time to disentangle the clothes. In the first to third balancing operations, the drum is rotated at about 108 rpm for a specific time to uniformly arrange the clothes throughout the inside of the drum to balance the drum.

After each of the balancing operations, the eccentricity of the drum may be measured at least one time. That is, the first preliminary spin drying is carried out according to a first eccentricity measurement, the second preliminary spin drying is carried out according to a second eccentricity measurement, and then the main spin drying is carried out according to a third eccentricity measurement.

The preliminary spin dryings may be carried out two or more times to prevent noise and overload on the motor that occur when a large amount of water is removed at once from the clothes at an initial stage of the spin-drying process. In detail the preliminary spin drying operations are carried out as follows: the drum is accelerated to 170 rpm and decelerated to 108 rpm in the first preliminary spin drying; the eccentricity of the drum is measured (second measurement) as the drum is rotated at the speed of 108 rpm; and the drum is accelerated from the speed of 108 rpm to a speed of 300 rpm and decelerated back to the speed of 108 rpm in the second preliminary spin drying. After these preliminary operations, the main spin drying is started by accelerating the drum to 600 rpm and then the drum is further accelerated until the spin drying process is completed.

During the spin-drying process, the drum is rotated by the motor. The motor drives the drum at a lower speed in a washing process and at a high speed in the spin-drying process.

However, the spin-drying process of the related art is carried out according to a fixed procedure regardless of the amount of the loaded clothes in the drum. Therefore, the preliminary spin dryings can be carried out more times and longer than really required, thereby delaying the start of the main spin drying and increasing the power consumption.

DISCLOSURE

Technical Problem

Accordingly, the present invention is directed to a drum type washing machine and controlling method thereof that substantially obviates one or more of the problems due to limitations and disadvantages of the related art.

An object of the present invention is to provide a drum type washing machine and controlling method thereof, in which an eccentricity of a drum is measured to control a preliminary spin drying operation not to be repeated to reduce time required to start a main spin drying operation after washing and rinsing operations.

Technical Solution

To achieve these and other advantages and in accordance with the purpose of the present invention, as embodied and broadly described, there is provided a drum type washing machine including: a tub; a drum installed in the tub to rotate about a horizontal axis; a driving motor rotating the drum; a key input unit receiving a washing instruction from a user; a memory storing a reference value for an eccentricity of the drum; a microcomputer controlling washing and rinsing operations in accordance with a procedure set by the user upon an input of a start command through the key input unit and preventing repetition of a preliminary spin drying operation using a measured eccentricity of the drum; and a driving control unit controlling velocity of the driving motor in accordance with a control signal of the microcomputer.

According to another aspect of the present invention, there is provided a controlling method of a drum type washing machine, including: performing washing and rinsing operations in accordance with a start command inputted by a user and a procedure selected by the user; performing an eccentricity measurement operation and a preliminary spin drying operation; re-performing the eccentricity measurement operation, and controlling the preliminary spin drying operation not to be repeated in accordance with a result of the re-performed eccentricity measurement operation; and performing a main spin drying operation.

According to a further another aspect of the present invention, there is provided a controlling method of a drum type washing machine, including: performing washing and rinsing operations according to an inputted condition; proceeding to a spin drying process right after the rinsing operation, and simultaneously performing a first eccentricity measurement operation on a drum of the drum type washing machine; comparing an eccentricity measured at the first eccentricity measurement operation with a reference value; performing a first preliminary spin drying operation according to the compared result; performing an n-th eccentricity measurement operation; determining whether an eccentricity measured at the n-th eccentricity measurement operation is larger than the reference value, and, if so, repeating the first eccentricity measurement operation until the eccentricity becomes smaller than the reference value; performing an n-th preliminary spin drying operation without repeating the first to an (n−1)-th preliminary spin drying operation; performing an (n+1)-th eccentricity measurement operation; starting a main spin drying operation according to a comparison result between an eccentricity measured at the (n+1)-th eccentricity measurement operation and the reference value; and terminating the whole spin drying process after the main spin drying operation.

ADVANTAGEOUS EFFECTS

According to the present invention, the preliminary spin drying operations can be selectively performed depending on the measured eccentricity, thereby reducing time required to start the main spin drying operation after the washing and rinsing operations.

Further, the eccentricity of the drum is measured to prevent repetition of the preliminary spin drying operation, thereby reducing power consumption.

Furthermore, the reduced time for starting of the main spin drying operation also reduces the entire operational time of the drum type washing machine, thereby increasing user's satisfaction.

DESCRIPTION OF DRAWINGS

FIG. 2 is a cut-away view of a drum type washing machine according to the present invention.

FIG. 3 is a block diagram showing a control structure of a drum type washing machine according to the present invention.

FIG. 4 is a flowchart showing a controlling method of a drum type washing machine according to the present invention.

FIGS. 5A to 5C show motor rpm versus time graphs of a spin drying process of a drum type washing machine according to the present invention.

BEST MODE

Figure 1:
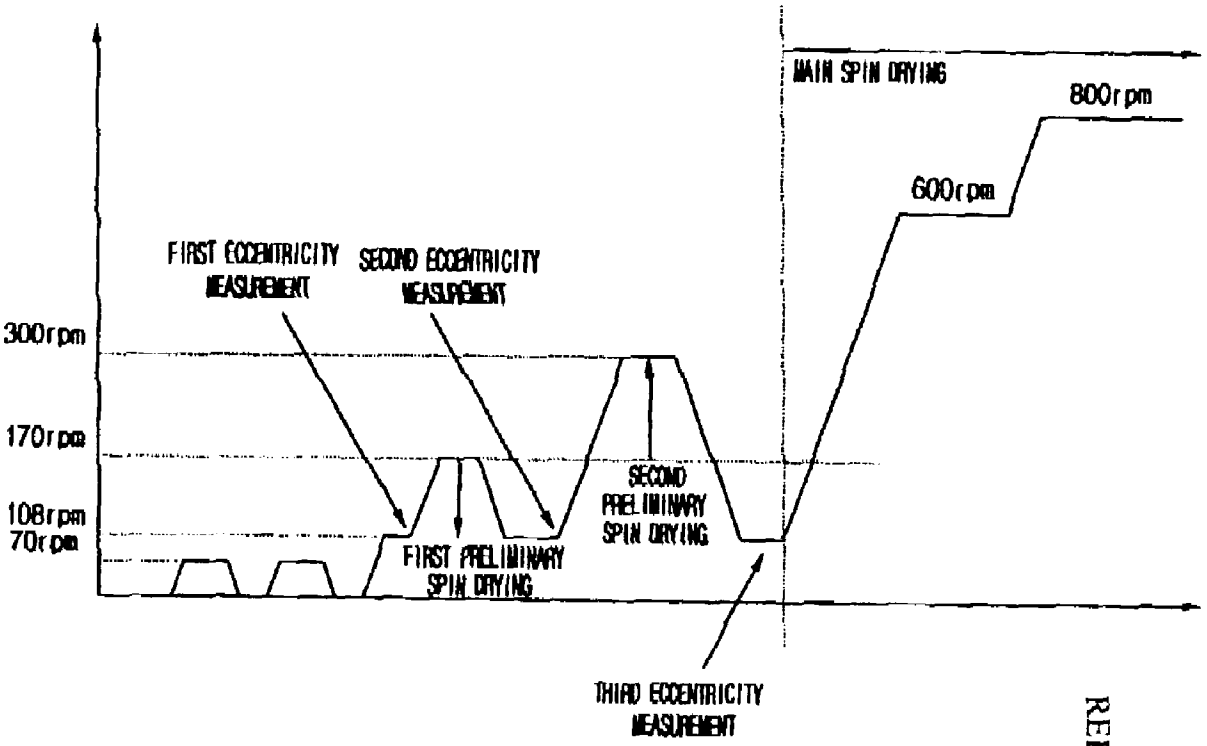
FIG. 1 is a motor rpm versus time graph of a spin drying of a drum type washing machine according to the related art.

Hereinafter, preferred embodiments of the present invention will be described in detail with reference to accompanying drawings.

The terms eccentricity, eccentricity of clothes, and eccentricity of a drum are interchangeably used here to refer to the degree of static unbalance or dynamic unbalance due to non-uniform arrangement of the clothes inside of the drum of a drum type washing machine.

FIG. 2 is a cut-away view of a drum type washing machine according to the present invention.

Referring to FIG. 2, a drum type washing machine includes an enclosing cabinet 1, a tub 2 supported by a damper 7 and a spring 6 in the cabinet 1, a cylindrical drum 3 installed in the tub 2 to rotate about a horizontal axis, and a driving motor 5 connected to the drum 3.

The driving motor 5 is connected to a back of the tub 2 and it includes a rotor 52 and a stator 51. The rotor 52 is connected to a drum shaft 4 without using a pulley and a belt for a direct power transmission to the drum 3.

Also, the drum type washing machine includes a door 8 on a front of the cabinet 1 to cover an opened front of the drum 3, a gasket 9 between the door 8 and the drum 3 to make the joint fluid-tight, and a control panel 10 above the door 8 to receive instructions from a user and control the overall operation of the drum type washing machine.

An operation of the drum type washing machine will now be described according to the present invention.

When a user select operating conditions using the control panel 10 and presses a start button, water flows into the drum 3 until the drum 3 is filled to a certain level, and the driving motor 5 is operated. By the operation of the driving motor 5, the rotational torque of the rotor 52 is transmitted to the drum shaft 4 to rotate the drum 3, and clothes in the drum 3 is lifted up by a lifer 31 and dropped down by gravity during the rotation of the drum 3. In this way a washing operation is carried out.

The up and down motions of the clothes in the drum 3 forces the water to frictionally pass through the clothes to remove dirt from the clothes. The clothes are cleaned by repetition of these motions.

In a spin drying operation after the washing operation, the drum 3 is rotated at a high speed to remove water from the clothes by a centrifugal force. A discharge pump is driven to discharge the water spun out from the clothes through a discharge line.

FIG. 3 is a block diagram showing a control structure of a drum type washing machine according to the present invention.

Referring to FIG. 3, the drum type washing machine includes a key input, unit 101, a microcomputer 102, a driving control unit 104, the driving motor 5, and a memory 103. With the key input unit 101, a user inputs operating conditions. The microcomputer 102 outputs control signals according to the operating conditions from the key input unit 101, and when the spin drying operation is started, the microcomputer 102 controls an eccentricity measurement to prevent a preliminary spin drying operation is uselessly repeated. The driving control unit 104 controls the driving motor 5 according to the control signals of the microcomputer 102, and the memory 103 stores a reference value for comparison with the measured eccentricity.

In operation, a user turns on the drum type washing machine and inputs desired operating conditions through the key input unit 101.

When the user inputs a start instruction through the key input unit 101, the microcomputer 102 controls the operation of the drum type washing machine according to the operating conditions inputted by the user and controls the washing machine to perform a first eccentricity measurement operation after washing and rinsing operations but before a spin drying operation.

If a first eccentricity measured is smaller than the reference value stored in the memory 103, a first preliminary spin drying operation is carried out. After that, a second eccentricity measurement is carried out to determine Whether a second eccentricity measured is bigger than the reference value. If so, the first eccentricity measurement is carried out again to balance the drum 3.

If a first eccentricity measured again is smaller than the reference value, namely if the drum is balanced, a second preliminary spin drying operation is carried out without repeating the first preliminary spin drying operation.

After the second preliminary spin drying operation, a third eccentricity measurement is carried out to determine whether a third eccentricity measured is bigger than the reference value. If so, the first eccentricity measurement is carried out again.

If a first eccentricity measured again is smaller than the reference value, namely if the drum 3 is balanced, a main spin drying is carried out without repeating the first and second preliminary spin dryings.

FIG. 4 is a flowchart showing a controlling method of a drum type washing machine according to the present invention, and FIGS. 5A to 5C show motor rpm versus time graphs of a spin drying process of a drum type washing machine according to the present invention.

Referring to FIGS. 4 and 5A to 5C, in operations S101 and S102, a user inputs a power-on instruction and selects desired operating conditions. In operations S103 to S105, clothes are washed and rinsed upon the press of start button and in accordance with the selected operating conditions. After the rinsing operation S105, the driving motor 5 stops and spin drying are started.

In operation S106, the driving motor 5 accelerates the drum 3 from a stationary state to a speed of about 108 rpm where the eccentricity of the drum 3 is to be measured (during this acceleration, the clothes are balanced along the inner side of the drum 3), and after the clothes are balanced a first eccentricity measurement and a first preliminary spin drying are carried out.

In detail, if the eccentricity measured is larger than the reference value stored in the memory 103, the drum 3 is decelerated to a stationary state and accelerated again to the speed of about 108 rpm to balance the clothes in the drum 3, and the first eccentricity measurement is performed again to measure the eccentricity. These balancing motions are repeatedly carried out until the eccentricity of the drum 3 becomes smaller than the reference value. Then, in the first preliminary spin drying operation, the drum 3 is further accelerated to a speed of about 170 rpm and kept at the speed for a predetermined time.

In operation S107, the drum 3 is decelerated from the speed of about 170 rpm to a speed of about 108 rpm and a second eccentricity measurement is performed.

In operation S108, it is determined whether a second eccentricity measured in operation S107 is larger than the reference value stored in the memory 103. If so, the first eccentricity measurement is performed again to balance the clothes in the drum 3 in operation S109.

In detail, if the second eccentricity measured in operation S107 is larger than the reference value, the drum 3 is decelerated to a stationary state and accelerated again to a speed of about 108 rpm to balance the clothes in the drum 3, and the first eccentricity measurement is performed again to measure the eccentricity. These balancing motions are repeatedly carried out until the eccentricity of the drum 3 becomes smaller than the reference value.

In operation S110, if the eccentricity of the drum 3 becomes smaller than the reference value, a second preliminary spin drying is performed without repeating the first preliminary spin drying.

In detail, in the second preliminary spin drying, the drum 3 is further accelerated to a speed of about 300 rpm and kept at the speed for a predetermined time. After operation S110, the drum 3 is decelerated to a speed of about 108 rpm to perform a third eccentricity measurement.

In operation S112, it is determined whether a third eccentricity measured in operation S111 is larger than the reference value stored in the memory 103. If so, the first eccentricity measurement is performed again to balance the clothes in the drum 3 in operation S113. In detail, the drum 3 is decelerated to a stationary state and accelerated again to a speed of about 108 rpm to balance the clothes in the drum 3, and the first eccentricity measurement is performed again to measure the eccentricity. These balancing motions are repeatedly carried out until the eccentricity of the drum 3 becomes smaller than the reference value.

If the eccentricity of the drum 3 becomes smaller than the reference value, a main spin drying is performed without repeating the first preliminary spin drying and the second preliminary spin drying in operation S114.

In detail, the drum 3 is further accelerated to a speed of about 600 to 800 rpm and kept at the speed for a predetermined time in operation S114. In operation S115, it is determined if the main spin drying is completed. When the main spin drying operation is completed, all spin drying operations are ended. Herein, the number of the preliminary spin drying operations may be automatically determined by the microcomputer 102 according to the amount of clothes to be cleaned and/or the weight of the water-containing clothes after the washing and rinsing processes.

Also, the same reference value or different reference values may be used for the first to the third eccentricity measurement operations.

According to the present invention, after the first eccentricity measurement operation and the first preliminary spin drying operation are carried out, the second eccentricity measurement is performed to determine whether the eccentricity of the drum is larger than the reference value, as shown in FIG. 5A. If so, the first eccentricity measurement is performed again as shown in FIG. 5B until the eccentricity becomes smaller than the reference value. Then, the second preliminary spin drying operation is performed without repeating the first preliminary spin drying operation.

Further, the third eccentricity measurement is performed after the second preliminary spin drying operation to determine whether the eccentricity is larger than the reference value. If so, the first eccentricity measurement operation is performed again as shown in FIG. 5C until the eccentricity becomes smaller than the reference value. Then, the main spin drying operation is performed without repeating the first and the second preliminary spin drying operations.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

According to the present invention, the preliminary spin drying operations are selectively carried out depending on the eccentricity of the drum, such that the time required to start the main spin drying operation after the washing and rinsing operations can be reduced, and the drum type washing machine can be operated with less power consumption. Therefore, the present invention can be applied to various fields.

The invention claimed is:

1. A controlling method of a drum type washing machine having a microcomputer programmed to control operations, the method comprising:

performing washing and rinsing operations in accordance with a start command inputted by a user and a procedure selected by the user;

performing a first eccentricity measurement operation;

performing a first preliminary spin drying operation if the first eccentricity measurement is smaller than a first reference value;

performing a second eccentricity measurement operation and comparing a second eccentricity measured at the second eccentricity measurement operation with the first reference value;

re-performing the first eccentricity measurement if the second eccentricity is larger than the first reference value;

comparing a first eccentricity measured at the re-performed first eccentricity measurement with a second reference value;

performing a second preliminary spin drying operation without re-performing the first preliminary spin drying operation if the first eccentricity is smaller than the second reference value; and performing a main spin drying operation.

2. The controlling method according to claim 1, further comprising:

performing a third eccentricity measurement operation after the second preliminary spin drying operation to determine whether the measured eccentricity is larger than or equal to a third reference value, and, if so, re-performing the first eccentricity measurement operation a second time; and proceeding to the performing of the main spin drying operation without re-performing the first spin drying operation and the second spin drying operation if an eccentricity measured at the secondly re-performed first eccentricity measurement operation is smaller than or equal to the first reference value.

3. A controlling method of a drum type washing machine having a microcomputer programmed to control operations, the method comprising:

performing washing and rinsing operations according to an inputted condition; proceeding to a spin drying process right after the rinsing operation, and simultaneously performing a first eccentricity measurement operation on a drum of the drum type washing machine;

comparing an eccentricity measured at the first eccentricity measurement operation with a first reference value;

performing a first preliminary spin drying operation according to the compared result;

performing a second eccentricity measurement operation;

determining whether an eccentricity measured at the second eccentricity measurement operation is larger than a second reference value, and, if so, repeating the first eccentricity measurement operation until the eccentricity becomes smaller than the first reference value;

performing a second preliminary spin drying operation without repeating the first preliminary spin drying operation;

performing a third eccentricity measurement operation;

starting a main spin drying operation according to a comparison result between an eccentricity measured at the third eccentricity measurement operation and a third reference value; and terminating the whole spin drying process after the main spin drying operation.

4. The controlling method according to claim 3, wherein the starting of the main spin drying operation comprises:

determining whether the eccentricity measured at the third eccentricity measurement operation is larger than the third reference value, and, if so, repeating the first eccentricity measurement operation until the eccentricity becomes smaller than the first reference value; and starting the main spin drying operation without repeating the first preliminary spin drying operation and the second preliminary spin drying operation.

5. The controlling method according to claim 3, wherein the starting of the main spin drying operation is carried out when the eccentricity measured at the third eccentricity measurement operation is smaller than the third reference value.

6. The controlling method according to claim 3, wherein the first eccentricity measurement operation includes balancing operation in which the drum is accelerated from a stationary state to a speed where the eccentricity of the drum is to be measured to uniformly distribute clothes throughout the inside of the drum.

7. The controlling method according to claim 6, wherein the balancing operation is carried out until the eccentricity measured at the first eccentricity measurement operation becomes smaller than the first reference value.

8. The controlling method according to claim 3, wherein after the performing of the second preliminary spin drying operation, the drum is decelerated to a speed equal to a speed where the first eccentricity measurement operation is carried out.

9. The controlling method according to claim 3, further comprising:

performing the second preliminary spin drying operation if the eccentricity measured at the second eccentricity measurement operation is not larger than the second reference value.

10. The controlling method according to claim 3, wherein the drum is rotated at a higher speed in the second preliminary spin drying operation than in the first preliminary spin drying operation.

11. The controlling method according to claim 3, wherein the same reference value is used for the eccentricity values measured at the first, the second and the third eccentricity measurement operations.

12. The controlling method according to claim 3, wherein different reference values are used for the eccentricity values measured at the first, the second and the third eccentricity measurement operations.

* * * * *